US007014140B2

(12) United States Patent
Elliott et al.

(10) Patent No.: US 7,014,140 B2
(45) Date of Patent: Mar. 21, 2006

(54) THREE ROLL TISSUE DISPENSER

(75) Inventors: Adam T. Elliott, Lexington, KY (US); Daniel J. Knight, Nicholasville, KY (US); Samir Dey, Lexington, KY (US)

(73) Assignee: Bay West Paper Corporation, Harrodsburg, KY (US)

( * ) Notice: Subject to any disclaimer, the term of this patent is extended or adjusted under 35 U.S.C. 154(b) by 172 days.

(21) Appl. No.: 10/769,321

(22) Filed: Jan. 30, 2004

(65) Prior Publication Data

US 2005/0167544 A1 Aug. 4, 2005

(51) Int. Cl.
*B65H 19/10* (2006.01)

(52) U.S. Cl. ..... 242/559.2; 242/597.5; 312/34.19

(58) Field of Classification Search ..... 242/559, 242/559.1, 559.2, 559.3, 560, 560.2, 564, 242/564.2, 594, 597.5, 599, 600, 613, 613.1, 242/613.2; 312/34.19, 34.22, 34.8
See application file for complete search history.

(56) References Cited

U.S. PATENT DOCUMENTS

| | | | | |
|---|---|---|---|---|
| 1,108,855 | A | | 8/1914 | Simons |
| 1,716,812 | A | | 6/1929 | Ball |
| 2,299,626 | A | | 10/1942 | Hunt |
| 2,726,823 | A | | 12/1955 | Jespersen |
| 2,905,405 | A | | 9/1959 | Burton et al. |
| 3,084,006 | A | | 4/1963 | Roemer |
| 3,085,762 | A | | 4/1963 | Subklew |
| 3,126,234 | A | | 3/1964 | Batlas et al. |
| 3,211,504 | A | | 10/1965 | Bump |
| 3,214,014 | A | | 10/1965 | Perrin |
| 3,294,329 | A | | 12/1966 | Tucker et al. |
| 3,381,909 | A | | 5/1968 | Tucker et al. |
| 3,387,902 | A | | 6/1968 | Perrin et al. |
| 3,433,355 | A | | 3/1969 | Smith |
| 3,437,388 | A | | 4/1969 | Jespersen |
| 3,438,589 | A | | 4/1969 | Jespersen |
| 3,650,487 | A | | 3/1972 | Bahnsen |
| 4,108,513 | A | | 8/1978 | Lander |
| 4,108,547 | A | | 8/1978 | Stemmle |
| 4,179,078 | A | * | 12/1979 | Mansfield ..... 312/34.22 |
| 4,223,964 | A | * | 9/1980 | Kilgore ..... 312/34.19 |
| 4,522,346 | A | | 6/1985 | Jespersen |
| 4,557,426 | A | | 12/1985 | Siciliano |
| 4,903,909 | A | | 2/1990 | Suzuki |
| 5,236,141 | A | | 8/1993 | Kewin |
| 5,310,129 | A | | 5/1994 | Whittington et al. |
| 5,356,086 | A | | 10/1994 | Takagi |
| 5,449,127 | A | * | 9/1995 | Davis ..... 242/560 |

(Continued)

FOREIGN PATENT DOCUMENTS

GB 2 104 871 * 3/1983

(Continued)

*Primary Examiner*—William A. Rivera
(74) *Attorney, Agent, or Firm*—Merchant & Gould, P.C.

(57) ABSTRACT

Improvements to a paper web material dispenser, for example a roll tissue dispenser or a roll paper towel dispenser, that has a user actuation mechanism for rotating a dispensing mechanism of the dispenser. The dispenser is designed to prevent excessive force that is applied to the user actuation mechanism from causing damage to components of the dispenser connected to the user actuation mechanism. A torque limiting mechanism is used to limit the torque that is applied to the dispensing mechanism of the dispenser when a user applies an excessive force to the user actuation mechanism. The torque applied to the dispensing mechanism is kept below a level that would be sufficient to cause damage to the dispensing mechanism or portions thereof.

26 Claims, 10 Drawing Sheets

U.S. PATENT DOCUMENTS 5,454,500 A * 10/1995 Chen ..... 225/46
5,605,001 A 2/1997 Derk
5,636,812 A 6/1997 Conner et al.
5,749,538 A 5/1998 Brown et al.
5,829,713 A 11/1998 Kewin
5,833,169 A 11/1998 Morand
6,302,352 B1 10/2001 Applegate
6,386,479 B1 5/2002 Lewis et al.
6,491,251 B1 12/2002 Stanland et al.
6,616,087 B1 * 9/2003 Chern ..... 242/559.2
6,648,267 B1 11/2003 Stanland et al.

FOREIGN PATENT DOCUMENTS

GB 2245882 1/1992
NL 8602194 3/1998

* cited by examiner

THREE ROLL TISSUE DISPENSER

FIELD OF THE INVENTION

The invention disclosed herein relates to the dispensing of paper web material, such as toilet tissue or paper towel, from at least one roll of paper web material contained within a dispenser. More particularly, the invention disclosed herein relates to a mechanism to limit the amount of force that a user is able to apply to mechanisms within the dispenser to prevent the user from damaging the dispenser. The inventive concepts will be described hereinafter primarily in relation to toilet tissue dispensers and dispensing tissue from toilet tissue rolls. It is to be realized that the inventive concepts described herein have applications to other types of paper web materials in addition to toilet tissue, including, but not limited to, paper towels.

BACKGROUND OF THE INVENTION

There has been continuing effort over the years to provide paper web material dispensers, for example toilet tissue dispensers, for dispensing paper web material to a user. To reduce the frequency of service visits needed to replenish toilet tissue dispensers, many tissue dispensers are designed to maximize the amount of tissue held therein. An example of such a dispenser is a large roll tissue dispenser utilizing a single, large roll of tissue material, such as is disclosed in U.S. Pat. No. 5,833,169. Another example is the type of tissue dispenser disclosed in U.S. Pat. Nos. 6,648,267 and 6,491,251 where a plurality of rolls of tissue are supported on a rotatable device within a housing to dispense tissue from one roll, while the remaining rolls are held in a reserve position waiting to be moved into a dispensing position once the roll currently at the dispensing position is completely or substantially depleted.

In the large roll tissue dispenser disclosed in U.S. Pat. No. 5,833,169, a turning knob is provided that allows a user to rotate the spindle upon which the tissue roll is disposed, thereby rotating the tissue roll. The provision of a turning knob so a user can rotate the roll is necessary when the tail end of the tissue is not hanging through the dispensing opening of the housing, but is instead disposed within the housing where it is difficult or impossible for the user to access. The knob allows the user to rotate the roll to bring the tail end of the tissue back to the dispensing opening. The tissue dispenser disclosed in U.S. Pat. Nos. 6,648,267 and 6,491,251 includes a user actuation disk through which a user is able to rotate the spider upon which a plurality of tissue rolls are disposed in order to bring a new roll into a dispensing position once the roll currently at the dispensing position is completely or substantially depleted.

It is possible that the dispenser can be damaged if excessive torque is applied to the turning knob or actuation disk of such dispensers. For example, if a paperjam or mechanical mechanism jam occurs in the dispenser, and the user attempts to overcome the jam by forcefully rotating the turning knob or actuation disk, damage to the dispenser can occur if the applied force is large enough. Further, in the dispenser disclosed in U.S. Pat. Nos. 6,648,267 and 6,491,251, if the roll currently at the dispensing position is not sufficiently depleted, and the user attempts to force a new roll to the dispensing position, damage to the dispenser can occur.

There is a need for an improved paper web material dispenser, for example a roll tissue dispenser, that has a user actuation mechanism, where the dispenser is designed to prevent excessive force that is applied to the user actuation mechanism from damaging the dispenser.

SUMMARY OF THE INVENTION

The invention relates to improvements to a paper web material dispenser, for example a roll tissue dispenser or a roll paper towel dispenser, that has a user actuation mechanism for rotating a dispensing mechanism of the dispenser. A dispenser according to the invention is designed to prevent excessive force that is applied to the user actuation mechanism from causing damage to components of the dispenser connected to the user actuation mechanism.

In particular, a dispenser according to the invention is able to limit the torque that is applied to the dispensing mechanism of the dispenser when a user applies an excessive force to the user actuation mechanism. The torque applied to the dispensing mechanism is kept below a level that would be sufficient to cause damage to the dispensing mechanism or portions thereof.

The concepts of the invention can be applied to numerous types of paper web material dispensers. However, the concepts of the invention have particular use with a tissue dispenser that is designed to hold multiple, e.g. three or four, tissue rolls, and where the dispenser is designed to permit the rolls to be brought sequentially to a dispensing position upon complete or substantial depletion of tissue from the roll that is currently at the dispensing position. The rolls used with the preferred dispenser are preferably reduced core tissue rolls, where each roll has first and second core sections that are spaced apart from each other to form a gap between facing ends thereof so that the total length of the core sections is less than the width of the tissue wound onto the core sections. Reduced core tissue rolls are disclosed in U.S. Pat. Nos. 6,648,267 and 6,491,251.

In accordance with a first aspect of the invention, a paper web material dispenser comprises a housing having a housing interior, and a dispensing mechanism disposed within the housing interior and mounted for rotation about an axis. The dispensing mechanism is configured to support at least one roll of paper web material thereon. In addition, a user actuation mechanism is accessible from outside the housing, with the user actuation mechanism being supported by the dispenser for movement relative to the housing. A drive mechanism connects the actuation mechanism to the dispensing mechanism, and a slip clutch mechanism is provided that is configured to prevent rotation of the dispensing mechanism when the actuation mechanism is actuated with a force that exceeds a predetermined limit.

In another aspect of the invention, a paper web material dispenser comprises a housing having a housing interior, and a dispensing mechanism disposed within the housing interior and mounted for rotation about an axis. The dispensing mechanism is configured to support at least one roll of paper web material thereon. In addition, a user actuation mechanism is accessible from outside the housing, with the user actuation mechanism being supported by the dispenser for movement relative to the housing. A drive mechanism connects the actuation mechanism to the dispensing mechanism, and a torque limiting mechanism is provided that is configured to automatically disconnect the dispensing mechanism from the actuation mechanism when the actuation mechanism is actuated with a torque that exceeds a predetermined limit and that is configured to automatically reconnect the dispensing mechanism and the actuation mechanism when the torque on the actuation mechanism falls below the predetermined limit.

In yet another aspect of the invention, a toilet tissue dispenser comprises a housing having a housing interior, a dispensing mechanism disposed within the housing interior and mounted for rotation about an axis. The dispensing mechanism is configured to support at least one roll of toilet tissue thereon. In addition, a rotatable actuation disk is supported by the dispenser on the outside of the housing for rotation relative to the housing. Further, a drive mechanism connects the actuation disk to the dispensing mechanism, and the drive mechanism includes a torque limiting mechanism that is configured to prevent rotation of the dispensing mechanism when a torque applied to the actuation disk exceeds a predetermined limit.

In yet another aspect of the invention, a paper web material dispenser comprises a housing having a housing interior, and a dispensing mechanism disposed within the housing interior and mounted for rotation about an axis. The dispensing mechanism includes a plate, and a plurality of mandrels fixed to the plate and projecting therefrom in a direction generally parallel to the rotation axis of the dispensing mechanism. Each mandrel is configured to support a roll of paper web material thereon, and each mandrel comprises a first mandrel section and a second mandrel section. The first mandrel section has a radial dimension that is greater than a radial dimension of the second mandrel section, and each mandrel includes a ledge between the first and second mandrel sections. The ledge has a radial dimension that is equal to the difference between the radial dimension of the first mandrel section and the radial dimension of the second mandrel section. In addition, a stop is disposed within the housing interior, where the stop includes a portion that projects radially into a rotation path of the mandrels, and where the radial distance that the stop projects into the rotation path is approximately equal to the radial dimension of the ledge.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION OF THE INVENTION

Figure 1:
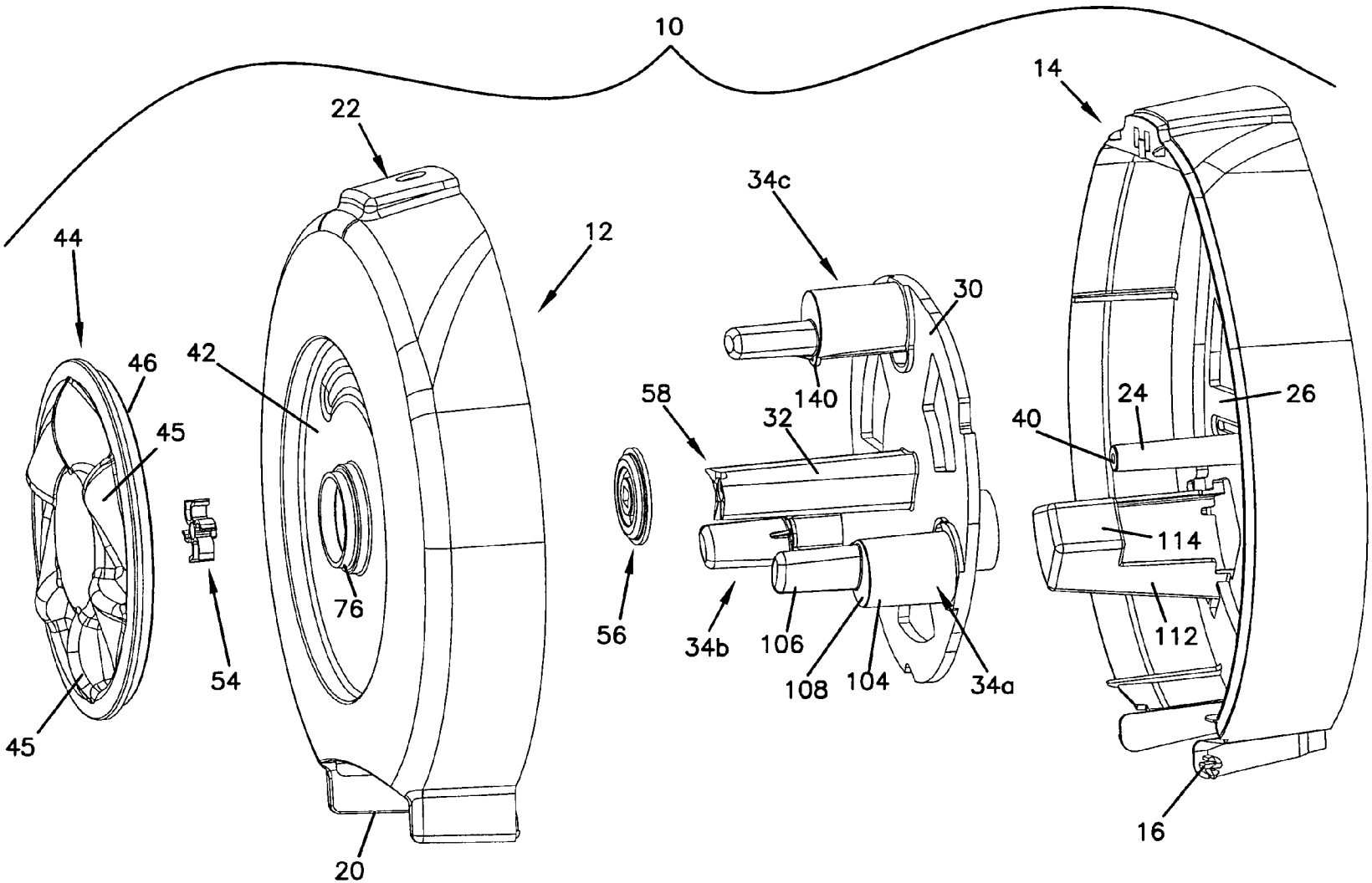
FIG. 1 is a front, exploded, perspective view of a dispenser in accordance with the invention.
Figure 2:
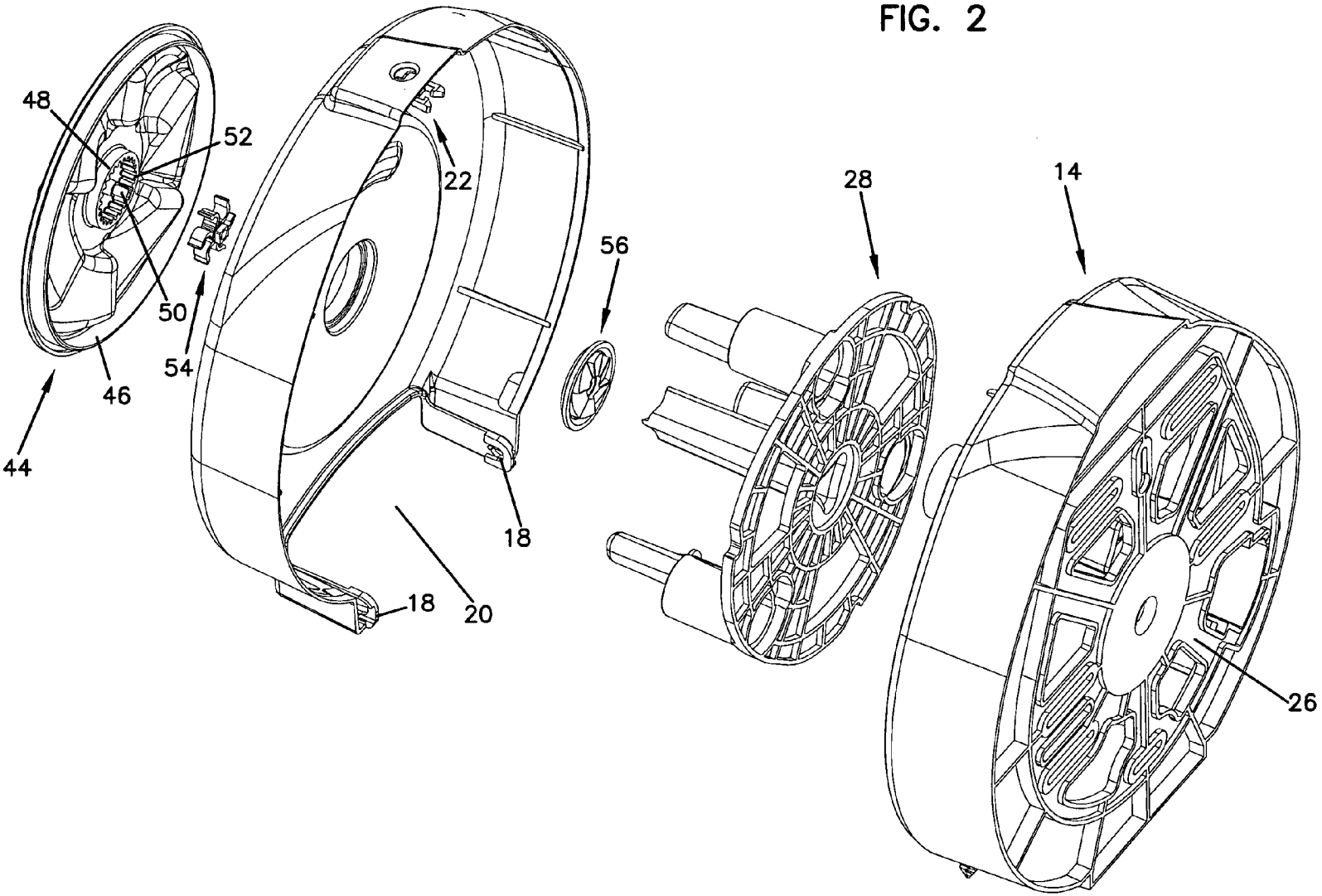
FIG. 2 is a rear, exploded, perspective view of the dispenser.
Figure 3:
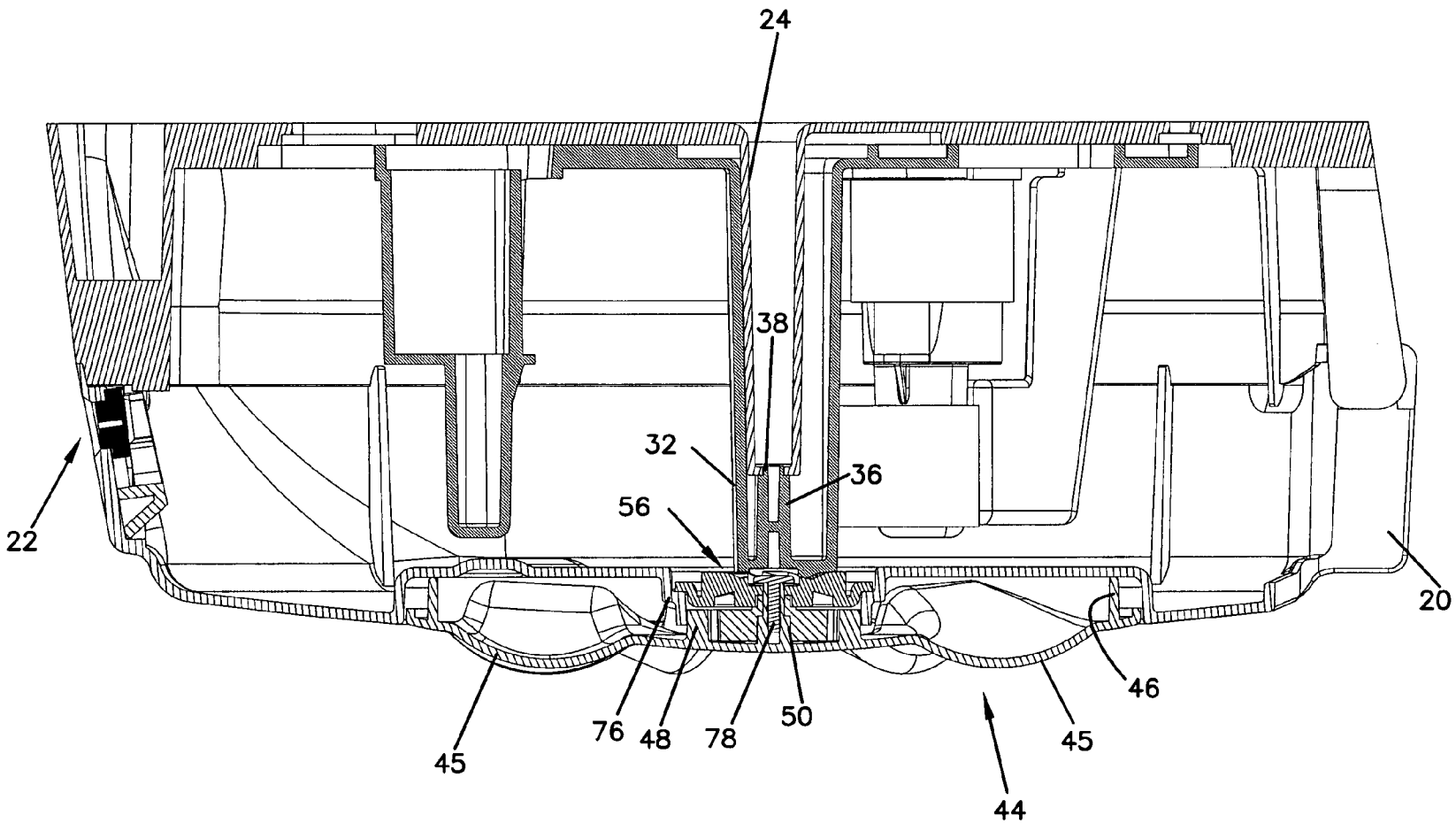
FIG. 3 is a cross-sectional view taken through the middle of the dispenser in an assembled condition.

A paper web material dispenser 10 that incorporates the concepts of the invention is illustrated in FIGS. 1–3. The illustrated dispenser 10 is a three roll toilet tissue dispenser. In the dispenser 10 described herein, when three tissues rolls are in the dispenser 10, a first roll is accessible for dispensing tissue while the second and third rolls are generally inaccessible until the first roll is completely depleted or substantially depleted. Once the first roll is completely depleted or substantially depleted, the dispenser then permits access to the second roll so that it can dispense tissue. Once the second roll is completely depleted or substantially depleted, the dispenser then permits access to the third roll so that it can dispense tissue.

The terms completely depleted and substantially depleted as used in this patent application mean all or a sufficient amount of tissue has been removed from a roll at the dispensing position to allow transfer to the next roll. For sake of convenience, the term depleted will hereinafter be used, it being understood that this term encompasses both complete depletion of tissue as well as depletion to an extent that permits transfer to the next roll.

While the dispenser 10 is described as a three roll toilet tissue dispenser, the concepts described herein can be used on tissue dispensers having a smaller, e.g. one, or larger, e.g. four, number of rolls, as well as on dispensers that dispense other types of paper web material, such as paper towel dispensers.

The dispenser 10 comprises a housing formed by a front cover 12, and a rear housing 14 that together define a housing interior. The rear housing 14 is configured for attachment to a wall or other support surface. The front cover 12 is pivotally connected to the rear housing 14 for pivoting movement relative to the rear housing between a closed position, shown in FIG. 3, and an open position (not shown). The front cover 12 is pivotable to the open position to provide access to the housing interior and the tissue rolls held therein, and to allow replenishment of the rolls.

Pivotal attachment of the front cover 12 to the rear housing 14 is provided by pivots 16 (shown in FIGS. 1, 8 and 9) on the rear housing 14 and flanges 18 on the front cover 12 with holes that receive the pivots 16. When the front cover 12 is closed, a dispensing opening 20 is formed by the front cover and the rear housing 14, through which the tail end of the tissue being dispensed extends for access by a user. A suitable locking mechanism 22, known to persons of skill in the art, is provided to maintain the cover at the closed position and deter access to the housing interior during use of the dispenser.

A support post 24 projects toward the front cover 12 from the back plate 26 of the rear housing 14, as shown in FIGS. 1–3. The support post 24 rotatably supports a dispensing mechanism 28 within the interior of the housing for dispensing tissue. As illustrated, the dispensing mechanism 28 comprises a plate 30, a generally hollow center post 32 that is fixed to the plate and projects toward the front cover 12, and a plurality of mandrels 34*a*, 34*b*, 34*c* that are fixed to the plate 30 and project therefrom toward the front cover.

With reference to FIG. 3, the post 32 is sized to fit over the support post 24. The interior of the post 32 includes a boss 36 with a pin 38 that fits into a hole 40 formed in the end of the post 24. This construction rotatably supports the dispensing mechanism 28 on the support post 24 and the rear housing 14.

Turning to FIGS. 1–3, the front side of the front cover 12 is recessed 42 and a user actuation mechanism in the form of an actuation disk 44 is rotatably disposed in the recess 42. The disk 44 has a stabilizing flange 46 extending from the rear thereof that, as best shown in FIG. 3, engages the base of the recess 42 to stabilize rotation of the disk 44. Further, the disk 44 includes a cylindrical drive boss 48 that surrounds a boss 50. The interior of the drive boss 48 is provided with teeth 52 that form part of a drive mechanism connecting the actuation disk 44 to the dispensing mechanism 28 so as to rotate the dispensing mechanism 28 upon rotation of the disk 44. Rotation of the disk 44 is facilitated by handles 45 formed on the front side of the disk. The drive mechanism also includes a torque limiting mechanism 54, a ratchet 56, and drive teeth 58 on the post 32.

The torque limiting mechanism 54 is configured to automatically disconnect the dispensing mechanism 28 from the actuation disk 44 when the actuation disk is rotated with a torque that exceeds a predetermined limit, and which automatically reconnects the dispensing mechanism and the actuation disk when the torque on the actuation disk falls below the predetermined limit. In the illustrated embodiment, the torque limiting mechanism 54 is in the form of a slip clutch mechanism that prevents rotation of the dispensing mechanism when the actuation disk is actuated with a force that exceeds the predetermined limit.

Figure 4:
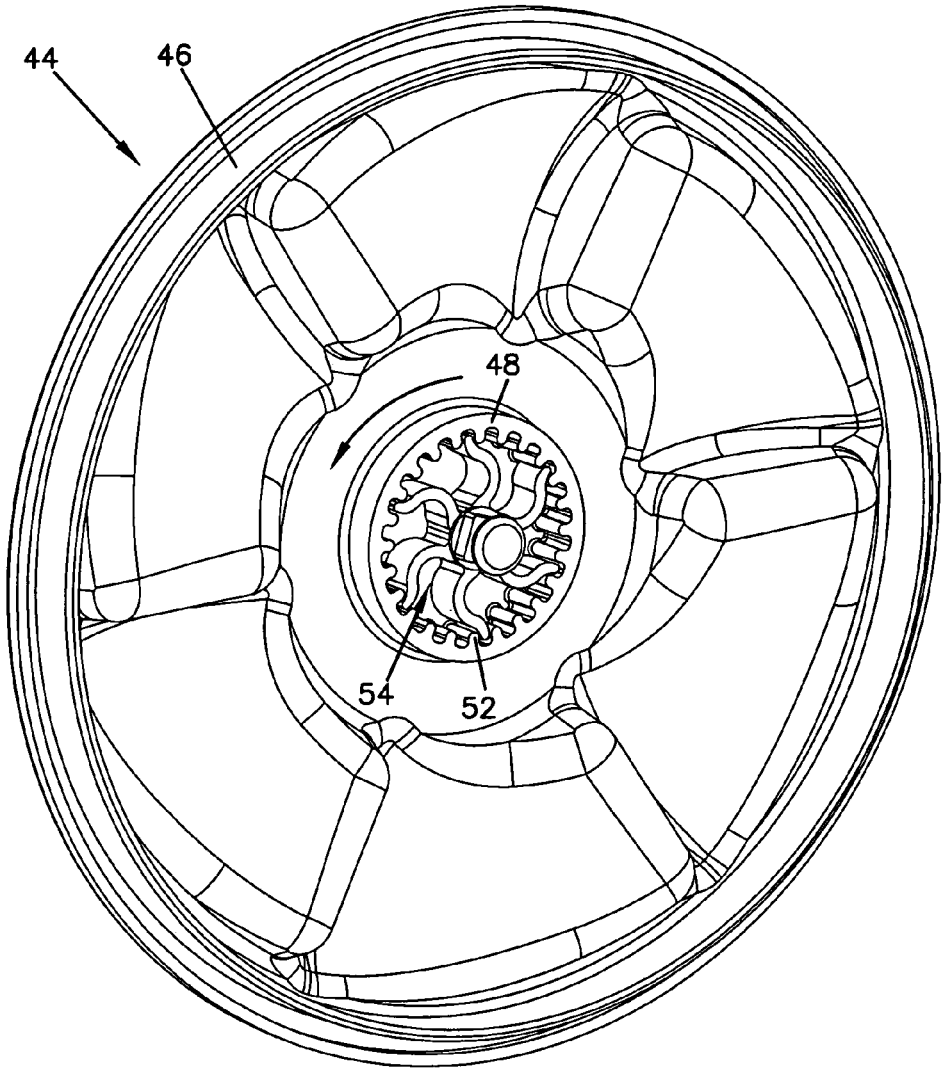
FIG. 4 is rear perspective view of the rotatable actuation disk together with the torque limiting mechanism.
Figure 7:
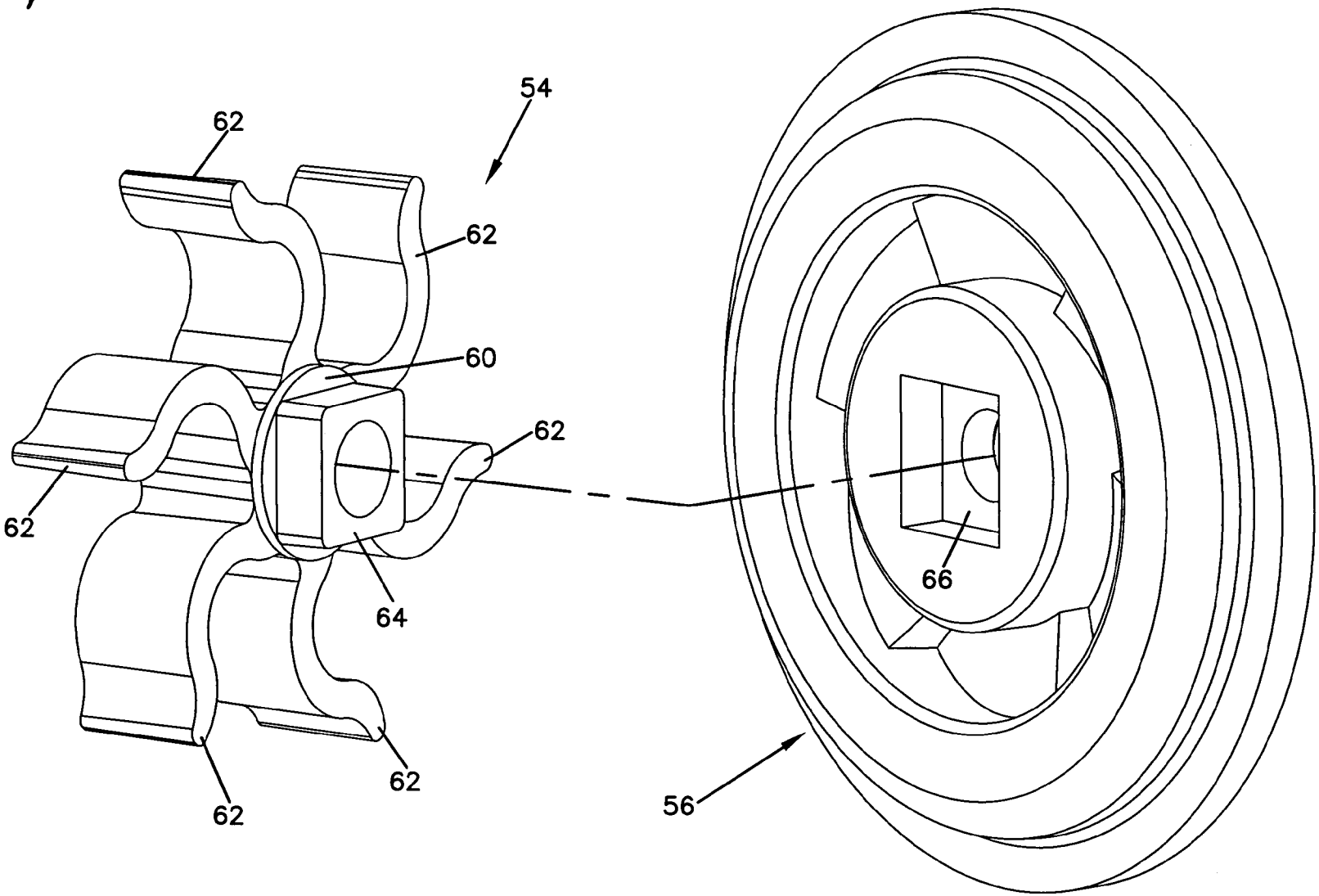
FIG. 7 illustrates how the torque limiting mechanism engages with the ratchet.

With reference to FIGS. 4 and 7, the torque limiting mechanism 54 is seen to include a hub 60 with a plurality of arms 62 projecting outwardly therefrom. The illustrated embodiment utilizes six arms 62, although a larger or smaller number of arms could be used. The arms 62, which are preferably formed of a flexible, resilient plastic, for example nylon or acetal, are curved in the intended direction of rotation of the disk 44 (the rotation direction is indicated by an arrow in FIG. 4). As also shown in FIG. 4, the hub 60 is able to fit within the boss 48, and the ends of the arms 62 are engaged with the teeth 52.

Due to the flexibility of the arms 62, the ends of the arms 62 will flex out of the teeth 52 when the torque on the disk 44 exceeds a predetermined limit. Preferably, the arms 62 will automatically flex out of the teeth 52 at a torque limit of between approximately 50–60 in/lbs, which, in this disclosed embodiment, is roughly equivalent to 15 lbs of force applied to the handle 45. Americans with Disabilities Act (ADA) guidelines recommend that approximately 5 lbs of force applied to the handle 45 be sufficient to rotate the disk 44 when the dispenser is functioning properly.

When the arms flex out of the teeth, the dispensing mechanism 28 is disconnected from the disk 44 whereby rotation of the disk 44 will no longer be transmitted to remaining portions of the drive mechanism so that the dispensing mechanism will not be rotated. However, when the torque falls below the predetermined limit, the arms 62 will automatically flex back into engagement with the teeth 52, thereby reconnecting the dispensing mechanism 28 and the disk 44 so that rotation of the disk results in rotation of the dispensing mechanism.

Figure 6:
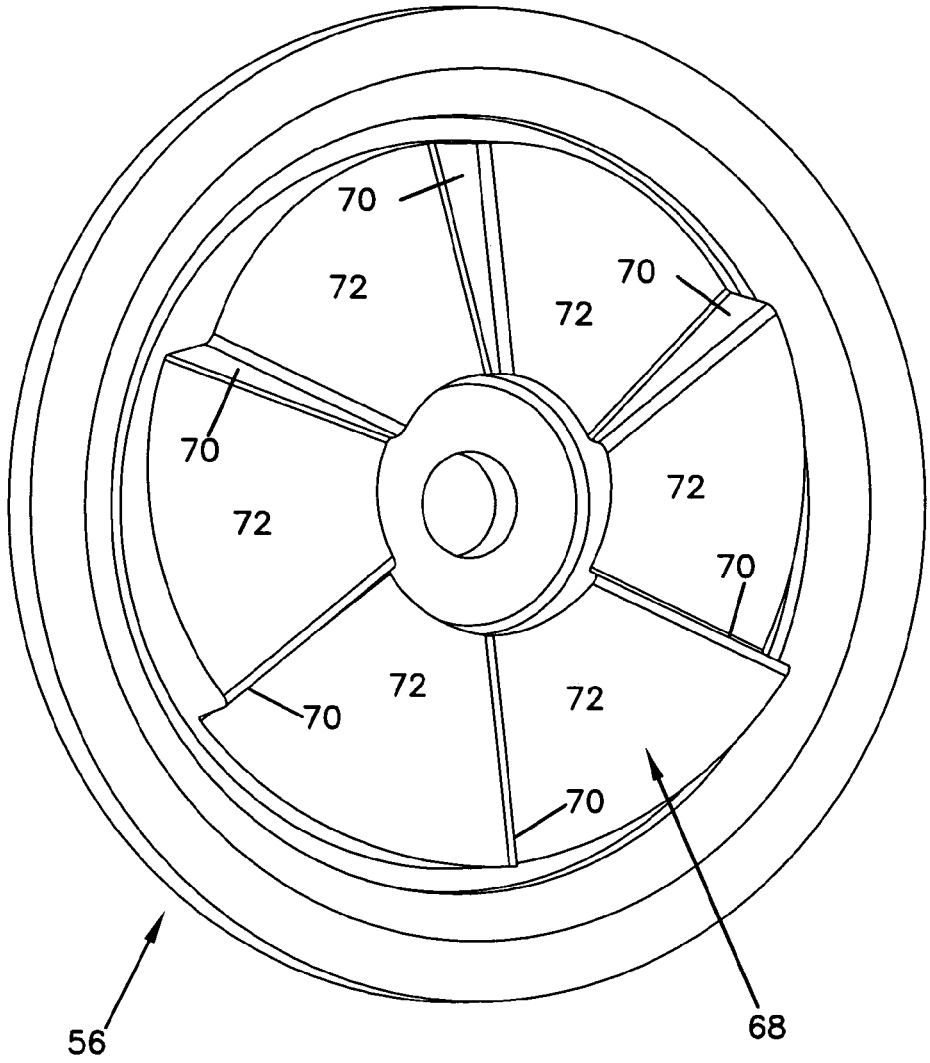
FIG. 6 is a rear perspective view of the ratchet.

The hub 60 of the torque limiting mechanism 54 also includes a square drive projection 64 extending rearwardly therefrom, as shown in FIG. 7. The projection 64 is sized to fit closely into a correspondingly shaped hole 66 formed in the front side of the ratchet 56. In this manner, rotation of the torque limiting mechanism 54 will drive the ratchet 56. As shown in FIG. 6, the back side of the ratchet 56 is provided with a plurality of drive teeth 68. The teeth 68 are preferably configured for one-way drive capability, with the teeth 68 each having a drive face 70 and sloped, non-driving faces 72 between the drive faces 70.

Figure 5:
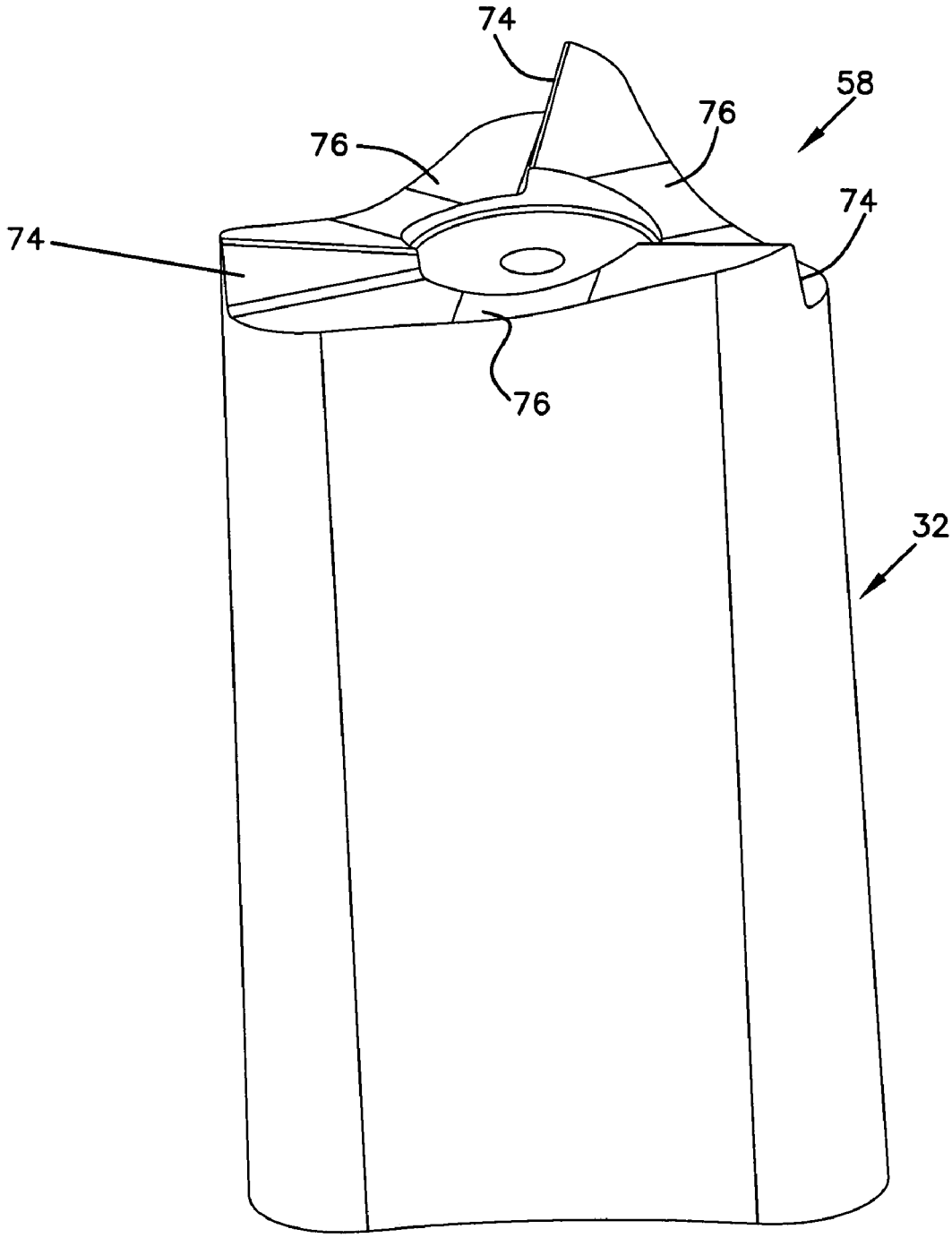
FIG. 5 is a detailed view of a portion of the center post of the dispensing mechanism.

With reference to FIG. 5, the drive teeth 68 of the ratchet 56 are engaged with the drive teeth 58 formed at the end of the post 32. The drive teeth 58, like the drive teeth 68, each have a drive face 74 and sloped, non-driving faces 76 between the drive faces 74.

The assembled arrangement of parts is illustrated in FIG. 3. As shown, the torque limiting mechanism 54 fits within the boss 48, with the arms 62 thereof engaged with the teeth 52. The ratchet 56 is supported within a boss 76 on the front cover 12, and the boss 50 extends through and beyond the torque limiting mechanism 54 and ratchet 56. A screw 78 is inserted into the boss 50 and tightens to the boss 50, but does not tighten to the torque limiting mechanism 54 or ratchet 56. Therefore, the disk 44, boss 50 and screw 78 will turn freely relative to the torque limiting mechanism 54 and ratchet 56 when torques above the predetermined limit are applied.

The dispenser 10 is configured so that rotation of the disk 44 in one direction only can result in rotation of the dispensing mechanism 28. In particular, when a user is facing the front of the dispenser, only rotation of the disk 44 in a clockwise direction can result in rotation of the dispensing mechanism in a corresponding clockwise direction. Rotation of the disk 44 in a counterclockwise direction will not rotate the dispensing mechanism because the drive faces 70 of the drive teeth on the ratchet 56 and the drive faces 74 of the drive teeth 58 on the end of the post 32 will not engage due to the configuration of the drive teeth 58, 68. However, clockwise rotation of the disk 44 can result in rotation of the dispensing mechanism, because the drive faces 70 of the drive teeth on the ratchet 56 and the drive faces 74 of the drive teeth 58 on the end of the post 32 will engage.

However, rotation of the dispensing mechanism will only occur if the torque on the disk 44 is below the predetermined limit. Malfunctions in the operation of the dispensing mechanism is 28 can cause the torque to increase above the predetermined limit. For example, the dispensing mechanism could become jammed due to a mechanical malfunction or due to tissue paper. Alternatively, a tissue roll that is currently at the dispensing position may not be sufficiently depleted, as will be discussed further below, thereby preventing rotation of the dispensing mechanism. Whatever the cause, if the dispensing mechanism is unable to rotate, and a user applies increasing force to the disk 44 in an effort to force rotation, the flexible arms 62 of the torque limiting mechanism 54 will cause the disk 44 to rotate or slip relative to the torque limiting mechanism when the applied torque exceeds the predetermined limit. This prevents the excessive force from being applied to the remainder of the drive mechanism and to the dispensing mechanism, thereby avoiding potential damage to the dispenser.

Referring now to FIGS. 1 and 8–10, the details of the dispensing mechanism 28 will now be described. Although these features of the dispensing mechanism are described as being used together with the torque limiting concept discussed above, it is to be realized that the hereinafter described features can be used in a dispenser that does not utilize the disclosed torque limiting concept.

Figure 10:
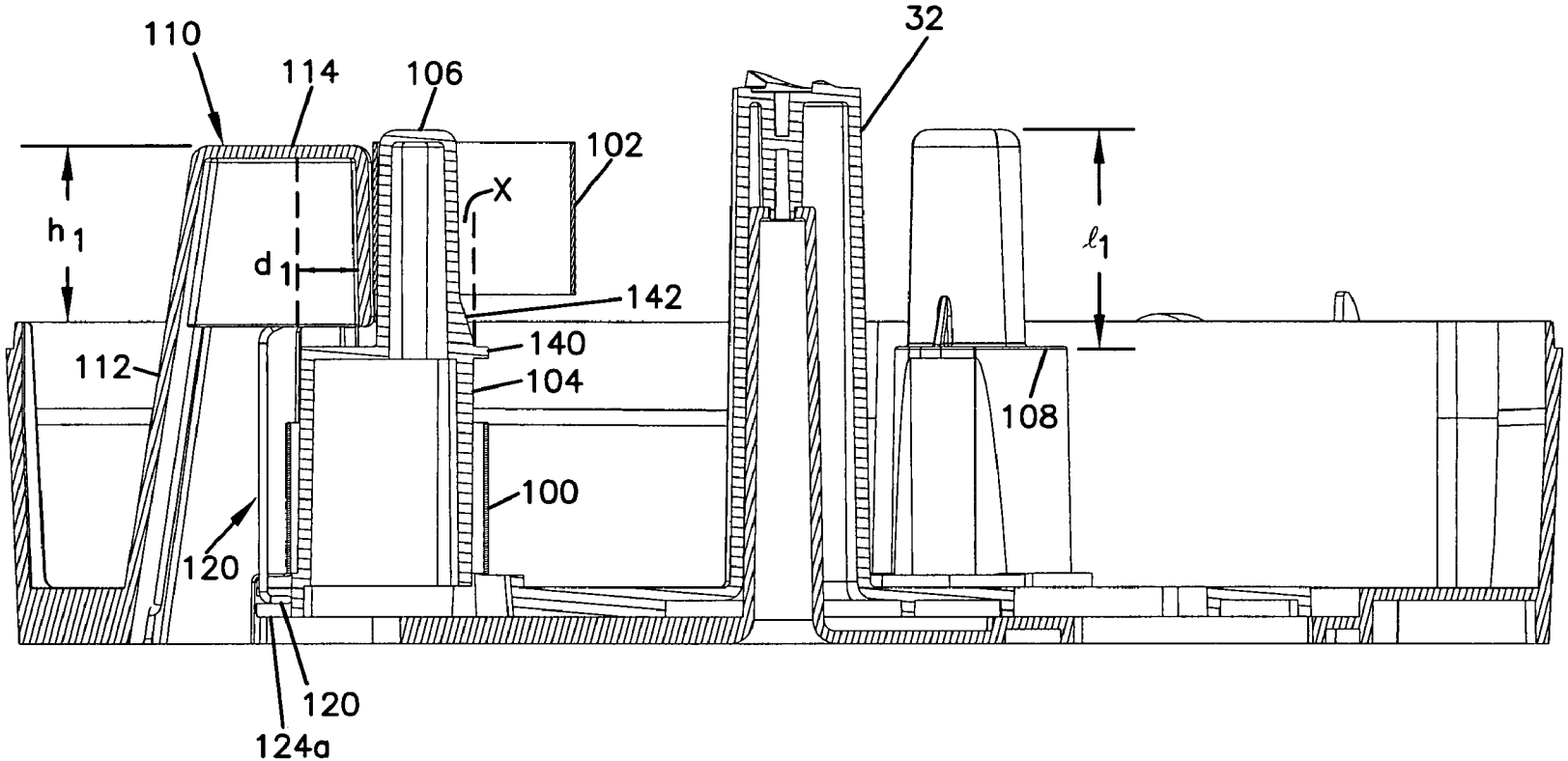
FIG. 10 is a cross-sectional view taken along line 10—10 of FIG. 9.

With reference initially to FIGS. 1 and 10, the mandrels 34*a–c,* which are identical in construction, each project from the plate 30 in a direction that is generally parallel to the axis of rotation of the dispensing mechanism. Each mandrel 34*a–c* is designed to support a tissue roll during use, so the size of the mandrels should be chosen to permit the cores of the tissue rolls to fit over the mandrels and permit rotation of the core relative to the mandrel when tissue is being pulled from each roll. The mandrels are preferably designed for use with reduced core tissue rolls. Reduced core tissue rolls are rolls having cores comprised of first and second core sections 100, 102 (shown in FIG. 10) that are spaced apart from each other to form a gap between facing ends thereof so that the total length of the core sections is less than the width of the tissue wound onto the core sections. Reduced core tissue rolls are described in U.S. Pat. Nos. 6,648,267 and 6,491,251.

Figure 8:
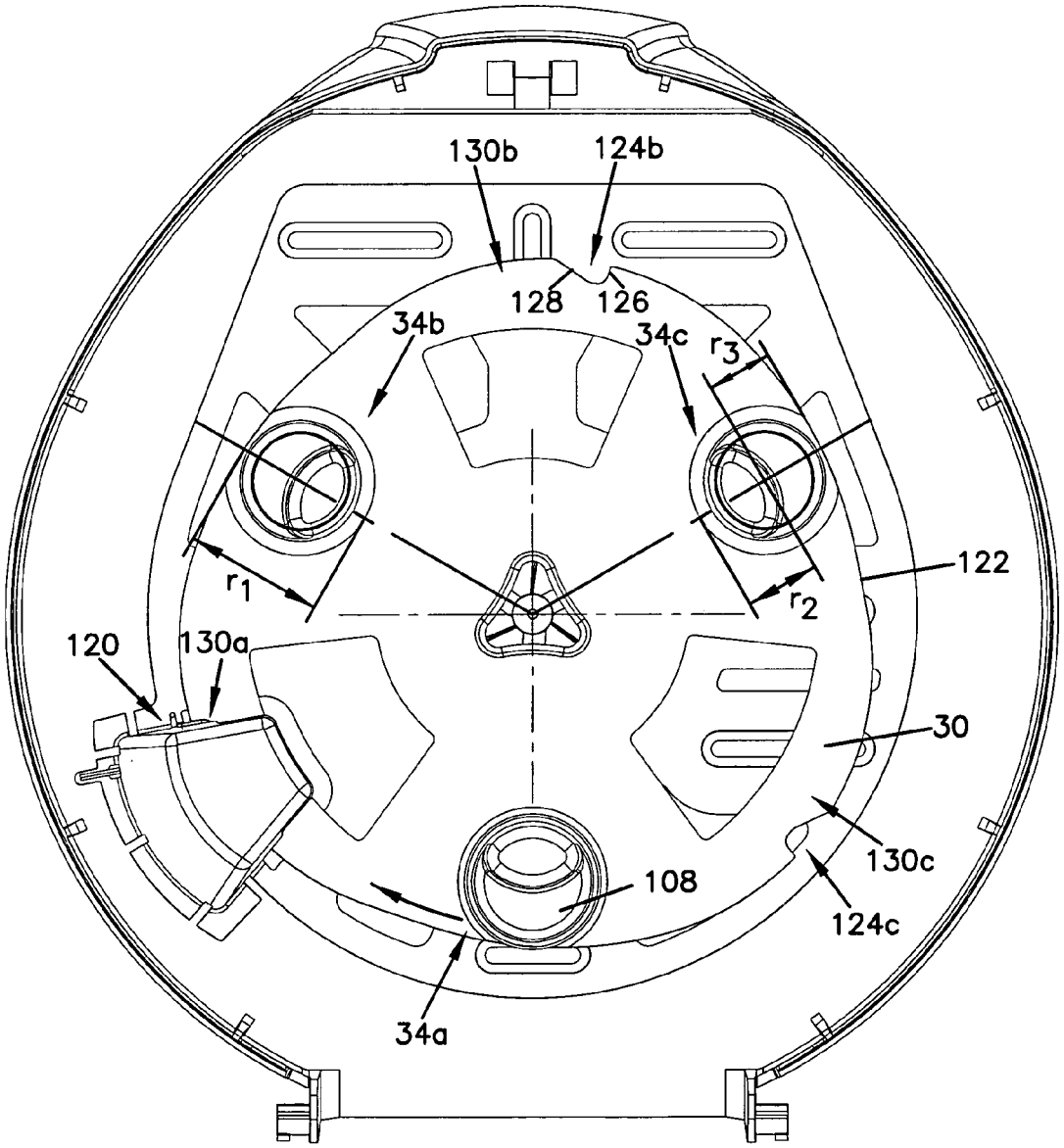
FIG. 8 is a front view of the dispenser with the front cover removed and a depleted roll on one of the mandrels.

Each mandrel 34*a–c* comprises a first mandrel section 104 fixed to the plate 30, a second mandrel section 106 extending from the first mandrel section 104, and a ledge 108. As shown in FIG. 8, the first mandrel section 104 has a maximum radial dimension $r_1$ (i.e. a maximum dimension measured along the radial axis) that is greater than the maximum radial dimension $r_2$ of the second mandrel section 106. The difference in the sizes of the mandrel sections 104, 106 creates the ledge 108, whose radial dimension $r_3$ is equal to the difference between $r_1$ and $r_2$. The ledges 108 face radially outwardly for a purpose to be described below.

As shown in FIG. 10, the core section 100 is received on the mandrel section 104 in a relatively close fitting relation. In contrast, due to the smaller radial dimension of the mandrel section 106, the core section 102, which is the same diameter as the core section 100, is received loosely on the mandrel section 106. This permits the core section 102 to be pushed inwardly toward the post 32, as shown in FIG. 10, during rotation of the dispensing mechanism 28 to bring a new roll into the dispensing position upon depletion of a roll at the dispensing position.

Figure 9:
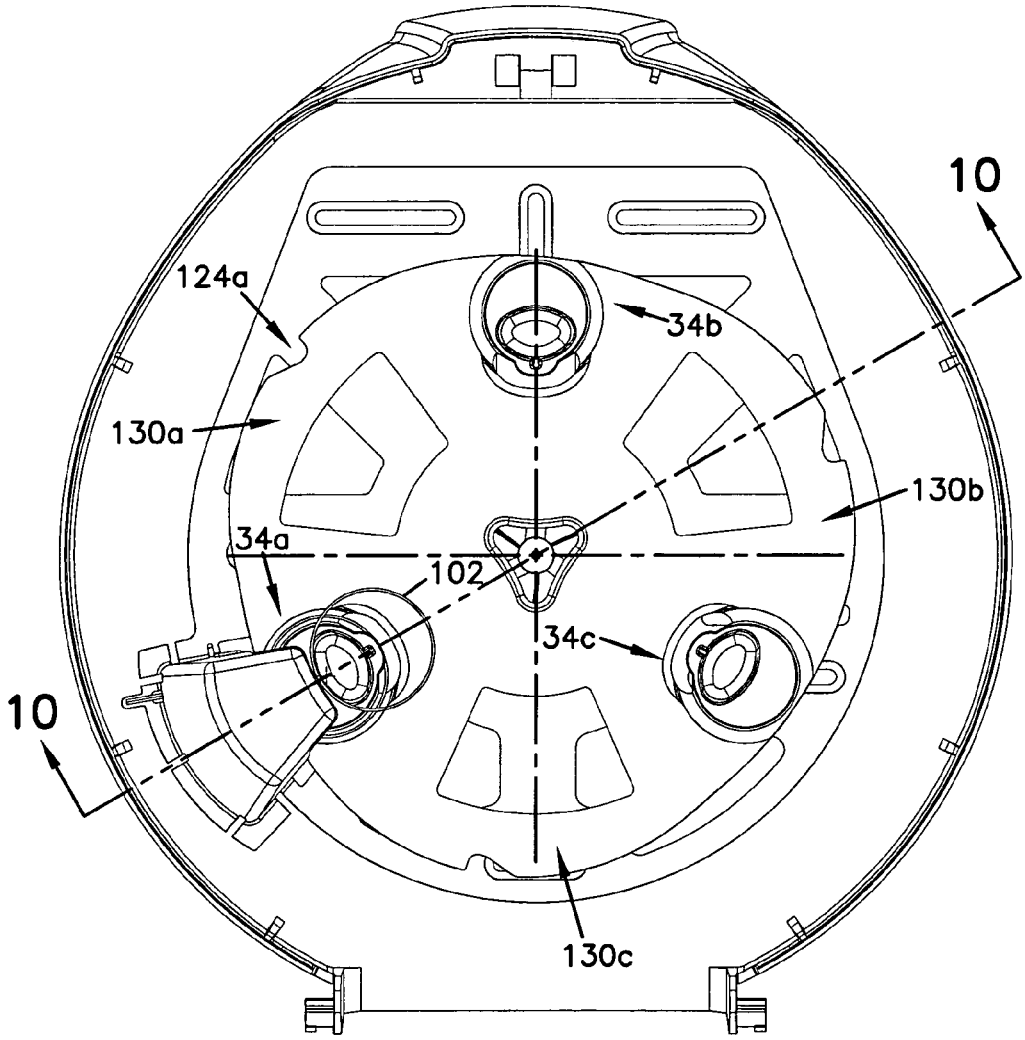
FIG. 9 is a front view similar to FIG. 8, with the dispensing mechanism rotated 45 degrees showing how the stop works.

With reference to FIGS. 8–10, a stop 110 is fixed to the back plate 26 of the rear housing 14. The stop 110 projects in the same general direction as the mandrels 34*a–c,* and includes a base portion 112 and a deflecting portion 114 that projects radially inwardly toward the post 32 into the rotation path of the mandrels 34*a–c*. The distance $d_1$ that the deflecting portion 114 projects into the rotation path is approximately equal to the radial dimension of the ledge 108. Further, the mandrel section 106 has a maximum length, $l_1$, measured along its axis of projection, and the deflecting portion 114 has a maximum height, $h_1$, that is less than the maximum length of the second mandrel section 106.

FIG. 8 illustrates the mandrel 34*a* at the dispensing position (e.g. positioned directly above the dispensing opening 20), with a depleted roll of tissue on the mandrel so that only the core sections 100, 102 remain. As the plate 30 is rotated in a clockwise direction in order to bring a new roll disposed on the mandrel 34*c* into the dispensing position, the mandrel 34*a* approaches the stop 110. As shown in FIGS. 9 and 10, the core section 102 engages the deflecting portion 114, which pushes the core section 102 inwardly toward the post 32. At the same time, the mandrel section 104 passes under the deflecting portion 114. In this manner, the mandrel 34*a* with the depleted roll thereon can pass by the stop 110 to bring the roll disposed on the mandrel 34*c* into the dispensing position.

If the roll on the mandrel 34*a* is not depleted, the mandrel 34*a* cannot pass by the stop 110. If the roll is not sufficiently depleted, the core section 102 cannot move inwardly toward the post 32 when it engages the deflecting portion 114 due to the amount of tissue remaining on the roll. In that instance, the stop 110 will prevent the new roll from being brought to the dispensing position until the roll on the mandrel 34*a* is sufficiently depleted to permit enough movement of the core section 102 inwardly toward the post 32 to permit the mandrel 34*a* to pass by the stop 110.

If the torque limiting mechanism 54 discussed above is used, and a user tries to bring a new roll to the dispensing position prior to the current roll at the dispensing position being depleted, the stop 110 will prevent such an action. However, if the user, faced with the stopping action of the stop 110, tries to force further rotation of the dispensing mechanism by rotating the actuation disk 44 even harder, damage could occur to the dispenser 10, for example the drive mechanism, portions of the dispensing mechanism 28, or the stop 110, if the applied torque is large enough. The torque limiting mechanism 54 will disconnect the driving force of the disk 44 from the remainder of the dispenser prior to the torque level reaching an amount at which damage to the dispenser can occur. As a result, damage to the dispenser is prevented.

The stop 110 further comprises a detent spring 118 that includes a detent finger 120 engaged with the perimeter edge 122 of the plate 30, as best shown in FIGS. 8 and 10. The finger 120 is resiliently biased into engagement with the perimeter edge 122 in order to maintain contact with the edge 122 as the plate 30 rotates. The edge 122 is provided with a plurality of detents 124*a,* 124*b,* 124*c* that cooperate with the detent finger 120 to help retain the mandrels 34*a–c* at the dispensing position. FIGS. 8 and 10 illustrate the detent finger 120 within the detent 124*a*.

Each detent 124*a–c* includes a front stop surface 126 and a ramp surface 128. When the detent finger 120 is within one of the detents 124*a–c,* the stop surface 126 engages with the finger 120 to prevent counterclockwise rotation of the plate 30. However, the ramp surface 128 allows the finger 120 to leave the detent when the plate 30 is rotated clockwise when bringing a new roll to the dispensing position.

As evident from FIGS. 8 and 9, the perimeter edge 122 of the plate 30 is non-circular. The shape of the edge 122 is such that it has three lobes 130*a,* 130*b,* 130*c* that have a radius greater than the radius of the edge 122 between the lobes 130*a–c*. The mandrels 34*a–c* are positioned adjacent the edge 122 at the smaller radiused portions of the plate 30 between the mandrels 34*a–c,* while the detents 124*a–c* are positioned at the lobes 130*a–c,* respectively. The shape of the edge 122 is such that the edge acts like a cam for the detent finger 120. When the plate 30 is rotated to begin a transfer to the next roll, the finger 120 rides on the smaller radiused portions of the edge 122. As the next mandrel gets closer to the dispensing position, the radius of the edge 122 increases and pushes on the finger 120 with increasing force. Eventually, the finger 120 snaps into place into the detent 124*a–c* to hold the mandrel at the dispensing position to dispense the new roll.

In addition, the mandrels 34*a–c* have features designed to keep the core sections 100, 102 separated when tissue is depleted. With reference to FIGS. 1 and 10, each mandrel 34*a–c* includes a tab 140 formed thereon at the intersection of the mandrel sections 104, 106. In the illustrated embodiment, the tab 140 projects radially inwardly. In addition, a sloped surface 142 extends between the mandrel section 106 and the tab 140. Further, as seen in FIG. 10, there is a small difference x between the radially inwardmost surface of the mandrel section 106 and the radially inwardmost surface of the mandrel section 104.

Referring to FIG. 10, as a roll is being placed on, for example, the mandrel 34*a,* the core section 100 rides on the sloped surface 142 so that the core section 100 can clear the tab 140. Once the roll is completely disposed on the mandrel 34*a*, the core sections 100, 102 will be arranged as shown in FIG. 10, with the core section 100 below the tab 140 and the core section 102 above the tab 140. The tab 140 limits movement of the core section 100 toward the core section 102, while the sloped surface 142 and tab 140 prevent the core section 102 from dropping down toward the core section 100. The result is that the core sections 100, 102 are kept separated. By keeping the core sections separated, the stop 110 will function as intended.

The embodiments of the invention disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

What is claimed is:

1. A paper web material dispenser, comprising:

a housing having a housing interior;

a dispensing mechanism disposed within the housing interior and mounted for rotation about an axis, the dispensing mechanism configured to support at least one roll of paper web material thereon;

a user actuation mechanism accessible from outside the housing, the user actuation mechanism being supported by the dispenser for movement relative to the housing;

a drive mechanism connecting the actuation mechanism to the dispensing mechanism; and a slip clutch mechanism that is configured to prevent rotation of the dispensing mechanism when the actuation mechanism is actuated with a force that exceeds a predetermined limit.

2. The dispenser of claim 1, wherein the actuation mechanism is a rotatable disk, and the slip clutch mechanism is configured to limit the torque that is applied to the dispensing mechanism when the disk is rotated.

3. The dispenser of claim 2, wherein the slip clutch mechanism forms part of the drive mechanism.

4. The dispenser of claim 2, wherein the slip clutch mechanism is rotatable with the disk about an axis that is coaxial to the rotation axis of the dispensing mechanism.

5. A paper web material dispenser, comprising:

a housing having a housing interior;

a dispensing mechanism disposed within the housing interior and mounted for rotation about an axis, the dispensing mechanism configured to support at least one roll of paper web material thereon;

a user actuation mechanism accessible from outside the housing, the user actuation mechanism being supported by the dispenser for movement relative to the housing;

a drive mechanism connecting the actuation mechanism to the dispensing mechanism; and a torque limiting mechanism that is configured to automatically disconnect the dispensing mechanism from the actuation mechanism when the actuation mechanism is actuated with a torque that exceeds a predetermined limit and that is configured to automatically reconnect the dispensing mechanism and the actuation mechanism when the torque on the actuation mechanism falls below the predetermined limit.

6. The dispenser of claim 5, wherein the actuation mechanism is a rotatable disk, and the torque limiting mechanism is configured to limit the torque that is applied to the dispensing mechanism when the disk is rotated.

7. The dispenser of claim 6, wherein the torque limiting mechanism forms part of the drive mechanism.

8. The dispenser of claim 6, wherein the torque limiting mechanism is rotatable with the disk about an axis that is coaxial to the rotation axis of the dispensing mechanism.

9. A toilet tissue dispenser, comprising:

a housing having a housing interior;

a dispensing mechanism disposed within the housing interior and mounted for rotation about an axis, the dispensing mechanism configured to support at least one roll of toilet tissue thereon;

a rotatable actuation disk supported by the dispenser on the outside of the housing for rotation relative to the housing; and a drive mechanism connecting the actuation disk to the dispensing mechanism, the drive mechanism includes a torque limiting mechanism that is configured to prevent rotation of the dispensing mechanism when a torque applied to the actuation disk exceeds a predetermined limit.

10. The dispenser of claim 9, wherein the torque limiting mechanism is rotatable with the disk about an axis that is coaxial to the rotation axis of the dispensing mechanism.

11. The dispenser of claim 9, wherein the dispensing mechanism is configured to support at least three rolls of toilet tissue.

12. The dispenser of claim 9, wherein the dispensing mechanism comprises a plate, a central post connected to the plate and projecting therefrom generally parallel to the rotation axis, and at least three mandrels connected to the plate and projecting therefrom generally parallel to the central post, the mandrels being equally spaced from each other on the plate.

13. The dispenser of claim 12, wherein each mandrel comprises a first mandrel portion connected to the plate, and a second mandrel portion connected to the first mandrel portion, wherein the second mandrel portion has a reduced size compared to the first mandrel portion to define a ledge on the mandrel.

14. The dispenser of claim 13, wherein the ledges face outwardly away from the rotation axis.

15. The dispenser of claim 12, further comprising a stop fixed to the housing and configured to engage web material rolls disposed on the mandrels.

16. The dispenser of claim 9, wherein the drive mechanism is configured to rotate the dispensing mechanism is a single direction about the rotation axis.

17. The dispenser of claim 16, wherein the dispensing mechanism comprises drive teeth, and wherein the drive mechanism further comprises a ratchet having drive teeth engaged with the drive teeth of the dispensing mechanism.

18. The dispenser of claim 17, wherein the torque limiting mechanism is in driving engagement with the ratchet, and the actuation disk is in driving engagement with the torque limiting mechanism.

19. The dispenser of claim 18, wherein the actuation disk comprises a dial with a cylindrical boss having inner gear teeth, and the torque limiting mechanism comprises a hub with a plurality of outwardly projecting arms, wherein the hub is disposed within the boss and the arms are engaged with the inner gear teeth.

20. The dispenser of claim 19, wherein the outwardly projecting arms are curved in a direction of rotation of the dispensing mechanism and are flexible, wherein the arms have sufficient flexibility so that the arms will flex out of engagement with the inner gear teeth when the torque applied to the actuation disk exceeds the predetermined limit.

21. A paper web material dispenser, comprising:

a) a housing having a housing interior;

b) a dispensing mechanism disposed within the housing interior and mounted for rotation about an axis, the dispensing mechanism includes:

i) a plate; and ii) a plurality of mandrels fixed to the plate and projecting therefrom in a direction generally parallel to the rotation axis of the dispensing mechanism, each mandrel is configured to support a roll of paper web material thereon, and each mandrel comprises a first mandrel section and a second mandrel section, the first mandrel section having a radial dimension that is greater than a radial dimension of the second mandrel section, and each mandrel includes a ledge having a radial dimension that is equal to the difference between the radial dimension of the first mandrel section and the radial dimension of the second mandrel section;

c) a stop disposed within the housing interior, the stop includes a portion that projects radially into a rotation path of the mandrels, and where the radial distance that the stop projects into the rotation path is approximately equal to the radial dimension of the ledge.

22. The dispenser of claim 21, wherein the second mandrel section has a maximum length measured along its axis of projection, and the portion of the stop that projects radially into the rotation path has a maximum height that is less than the maximum length of the second mandrel section.

23. The dispenser of claim 21, wherein the ledges are positioned to face radially outwardly.

24. The dispenser of claim 21, comprising three mandrels.

25. The dispenser of claim 24, wherein the plate includes a non-circular perimeter edge having three lobes.

26. The dispenser of claim 25, wherein the mandrels are positioned on the plate between the lobes.

* * * * *

UNITED STATES PATENT AND TRADEMARK OFFICE

CERTIFICATE OF CORRECTION

PATENT NO. : 7,014,140 B2
APPLICATION NO. : 10/769321
DATED : March 21, 2006
INVENTOR(S) : Elliott et al..

It is certified that error appears in the above-identified patent and that said Letters Patent is hereby corrected as shown below:

Col. 10, line 48, claim 16: “mechanism is a” should read --mechanism in a--

Signed and Sealed this

Fourth Day of July, 2006

JON W. DUDAS
*Director of the United States Patent and Trademark Office*